US011771239B2

(12) United States Patent
Hwang et al.

(10) Patent No.: US 11,771,239 B2
(45) Date of Patent: Oct. 3, 2023

(54) REFRIGERATOR

(71) Applicant: SAMSUNG ELECTRONICS CO., LTD., Suwon-si (KR)

(72) Inventors: In-Yong Hwang, Suwon-si (KR); Dong Nyeol Ryu, Suwon-si (KR); Oun Gu Lee, Suwon-si (KR); Ki Hak Hong, Suwon-si (KR); Gwang Chel Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 242 days.

(21) Appl. No.: 17/273,052

(22) PCT Filed: Aug. 20, 2019

(86) PCT No.: PCT/KR2019/010525
§ 371 (c)(1),
(2) Date: Mar. 3, 2021

(87) PCT Pub. No.: WO2020/050520
PCT Pub. Date: Mar. 12, 2020

(65) Prior Publication Data

US 2022/0408941 A1 Dec. 29, 2022

(30) Foreign Application Priority Data

Sep. 5, 2018 (KR) ..... 10-2018-0105874

(51) Int. Cl.
*A47F 3/04* (2006.01)
*F25D 21/04* (2006.01)
*F25D 23/02* (2006.01)

(52) U.S. Cl.
CPC ..... *A47F 3/0434* (2013.01); *F25D 21/04* (2013.01); *F25D 23/028* (2013.01)

(58) Field of Classification Search
CPC ..... A47F 3/0434; A47F 3/125; A47F 3/043; F25D 21/04; F25D 23/028;
(Continued)

(56) References Cited

U.S. PATENT DOCUMENTS 3,499,245 A * 3/1970 Richter ..... F25D 23/02 49/478.1
4,080,756 A 3/1978 Heaney
(Continued)

FOREIGN PATENT DOCUMENTS

CA 2983709 A1 * 5/2018 ..... A47F 3/0434
CA 2859293 C * 4/2020 ..... B60J 1/007
(Continued)

OTHER PUBLICATIONS

International Search Report dated Dec. 18, 2019 in International Patent Application No. PCT/KR2019/010525.
(Continued)

*Primary Examiner* — Hanh V Tran
(74) *Attorney, Agent, or Firm* — STAAS & HALSEY LLP

(57) ABSTRACT

Provided is a refrigerator including a door frame enhanced to support a door glass. The refrigerator includes a main body including a storeroom, a plurality of door glasses separately arranged to insulate the storeroom, an outer frame supporting an outer glass arranged on an outer side among the plurality of door glasses, an inner frame supporting an inner glass arranged on an inner side among the plurality of door glasses and including a same type of material as the outer frame, and an insulation member arranged between the outer frame and the inner frame and including a different type of material from the outer frame and the inner frame.

15 Claims, 7 Drawing Sheets

(58) Field of Classification Search
CPC ..... E06B 3/26336; E06B 3/6715; E06B 7/16; E06B 2003/2625
See application file for complete search history.

(56) References Cited

U.S. PATENT DOCUMENTS

| | | | | | |
|---|---|---|---|---|---|
| 4,145,844 | A * | 3/1979 | Kaspar | E05F 1/123 | 403/231 |
| 4,741,127 | A * | 5/1988 | Bockwinkel | E06B 3/26341 | 52/786.13 |
| 4,891,912 | A * | 1/1990 | Bockwinkel | F25D 23/082 | 49/478.1 |
| 4,998,382 | A | 3/1991 | Kostos et al. | | |
| 5,024,023 | A | 6/1991 | Kostos et al. | | |
| 5,035,085 | A * | 7/1991 | Mamelson | A47F 3/043 | 49/478.1 |
| 5,111,618 | A * | 5/1992 | Kaspar | A47F 3/043 | 49/504 |
| 5,255,473 | A * | 10/1993 | Kaspar | A47F 3/043 | 49/504 |
| 6,367,223 | B1 | 4/2002 | Richardson et al. | | |
| 7,043,886 | B1 * | 5/2006 | Chubb | F25D 23/028 | 52/204.5 |
| 9,016,031 | B2 | 4/2015 | Chubb et al. | | |
| 9,476,234 | B2 | 10/2016 | Louie et al. | | |
| 10,302,348 | B2 | 5/2019 | Lv et al. | | |
| 10,473,382 | B2 * | 11/2019 | Grenier | A47F 3/0434 | |
| 10,830,531 | B2 | 11/2020 | Seo et al. | | |
| 2008/0190046 | A1 * | 8/2008 | Hecht | A47F 3/0434 | 52/173.1 |
| 2016/0045038 | A1 * | 2/2016 | Chubb | A47F 3/043 | 428/34 |
| 2018/0038149 | A1 | 2/2018 | Strickland et al. | | |

FOREIGN PATENT DOCUMENTS

| | | | | | |
|---|---|---|---|---|---|
| CN | 1154821 | A * | 7/1997 | | |
| CN | 101784853 | A | 7/2010 | | |
| CN | 105143798 | A | 12/2015 | | |
| CN | 206626882 | U | 11/2017 | | |
| CN | 107976001 | A * | 5/2018 | | |
| CN | 108224887 | A | 6/2018 | | |
| EP | 1455045 | A1 * | 9/2004 | | A47F 3/0434 |
| EP | 3378360 | B1 * | 7/2022 | | A47F 3/0434 |
| JP | 10-339075 | | 12/1998 | | |
| JP | 3750283 | | 12/2005 | | |
| JP | 5027382 | | 6/2012 | | |
| KR | 10-2008-0028288 | | 3/2008 | | |
| WO | WO-0193727 | A2 * | 12/2001 | | A47F 3/0434 |
| WO | WO-2009024498 | A1 * | 2/2009 | | A47F 3/0434 |
| WO | WO-2012131472 | A1 * | 10/2012 | | E06B 1/62 |

OTHER PUBLICATIONS

Extended European Search Report dated Aug. 12, 2021 in European Application No. 19857306.5-1005.
European Office Action dated Dec. 16, 2022 for European Application No. 19857306.5.
Chinese Office Action dated Mar. 30, 2023 for Chinese Application No. 201980058089.8.

* cited by examiner

REFRIGERATOR

CROSS-REFERENCE TO RELATED APPLICATIONS

This application is a U.S. National Stage Application, which claims the benefit under 35 U.S.C. § 371 of PCT International Patent Application No. PCT/KR2019/010525, filed Aug. 20, 2019 which claims the foreign priority benefit under 35 U.S.C. § 119 of Korean Patent Application No. 10-2018-0105874, filed Sep. 5, 2018, the contents of which are incorporated herein by reference.

TECHNICAL FIELD

The disclosure relates to a refrigerator including an enhanced door frame to support a door glass.

BACKGROUND ART

Refrigerators are devices having a storeroom for storing foods and a cold air supply for supplying cold air into the storeroom to keep the foods fresh. The storeroom has an open front to put in or take out the foods, and the open front may be opened or closed by a door.

Beyond refrigeration of common foods, there is ever increasing demand for a refrigerator capable of keeping a special food item at a suitable temperature for the food item.

For example, the refrigerator may include a kimchi refrigerator for keeping kimchi in the best condition for a long time, and a wine refrigerator for keeping wine in the best condition to maintain the flavor of the wine.

In the case of the wine refrigerator in particular, the door includes a transparent glass for the user outside to see the wine inside through the glass. Hence, heat transfer through the door of the wine refrigerator may increase as compared to a urethane-based insulating door of a common grocery refrigerator.

To make up for this, the door of the wine refrigerator may include a plurality of glasses and contain a gas with a lower heat conductivity than air between the plurality of glasses, to improve insulation performance.

In the meantime, when dew condensation occurs on the door of the wine refrigerator due to high external humidity, more dew may be formed on edges of the plurality of glasses coupled with a frame that supports the glasses than in the central portion of the glasses.

Accordingly, the frame may require a function to suppress occurrences of dew condensation by blocking transfer of external heat inside the door while securely supporting the plurality of glasses.

In general, the frame may include an outer frame to support outer sides of the plurality of glasses and an inner frame to support inner sides of the plurality of glasses.

The outer frame may include a metal to prevent spreading of a fire when the fire breaks out in the wine refrigerator, and the inner frame may include low heat-conductive plastics to prevent a chill in the storeroom from being transferred to the outer frame.

As the outer frame and the inner frame coupled to each other include different materials so that a coefficient of linear expansion increases, when a change in temperature outside the wine refrigerator increases, the frame may be distorted, so outside air may be brought inside the door through the frame or the frame supporting the plurality of glasses may be decoupled from the plurality of glasses.

DESCRIPTION OF EMBODIMENTS

Technical Problem

The disclosure provides a refrigerator including a door that is manufactured at a reduced cost and in a simplified procedure.

The disclosure also provides a refrigerator including a door frame that has a metal to support a plurality of door glasses.

The disclosure also provides a refrigerator including an insulation member arranged between an outer frame and an inner frame and having a nonmetal.

Solution to Problem

According to an aspect of the disclosure, a refrigerator includes a main body including a storeroom, a plurality of door glasses separately arranged to insulate the storeroom, an outer frame supporting an outer glass arranged on an outer side among the plurality of door glasses, an inner frame supporting an inner glass arranged on an inner side among the plurality of door glasses and including a same type of material as the outer frame, and an insulation member arranged between the outer frame and the inner frame and including a different type of material from the outer frame and the inner frame.

The inner frame may include a same material as the outer frame.

A difference in coefficient of linear expansion between the inner frame and the outer frame is 10 um/mk or less.

The outer frame and the inner frame may be coupled by a screw.

The outer frame and the inner frame may include metals, and the insulation member may include a nonmetal.

The insulation member may be arranged along side edges of the plurality of door glasses.

The insulation member may include a first insulation member arranged adjacent to the outer glass and a second insulation member bending from the first insulation member towards the inner glass.

The outer frame may include a first cover part covering an outer surface of the outer glass, a first insulation part extending from the first cover part and contacting the insulation member, and a first coupling part provided at the first insulation part so that the outer frame is coupled to the inner frame and the insulation member.

The inner frame may include a second cover part covering an inner surface of the inner glass, a second insulation part extending from the second cover part and contacting the insulation member, and a second coupling part provided at the second insulation part so that the inner frame is coupled to the first coupling part and the insulation member.

The insulation member may include a coupling hole formed for the insulation member to be coupled with the outer frame and the inner frame.

The inner frame may include a first inner frame coupled with a gasket provided to seal the storeroom and a second inner frame arranged between the outer frame and the first inner frame.

The first inner frame may include a nonmetal, and the second inner frame may include a metal.

According to another aspect of the disclosure, a refrigerator includes a main body including a storeroom, and a door pivotally arranged at the main body to open or close the storeroom, and including a door glass and a door frame to support the door glass, wherein the door frame includes an outer frame supporting outer edges of the door glass and having a metal, and an inner frame coupled with the outer frame to support inner edges of the door glass and having a metal.

The door may further include an insulation member arranged between the outer frame and the inner frame and having a nonmetal.

The insulation member may include a plurality of insulation members arranged along sides of the door glass and separated from one another.

The door may further include a heater arranged at the outer frame to prevent occurrences of dew condensation on the door frame.

The door may further include a sensor measuring humidity outside the door so that the heater operates according to the outside humidity.

According to another aspect of the disclosure, a refrigerator includes a main body including a storeroom, and a door including a plurality of door glasses arranged to insulate the storeroom and a door frame supporting the plurality of door glasses so that the plurality of door glasses are separately arranged, wherein the door frame may include an outer frame and an inner frame coupled with the outer frame, which include a same type of material to prevent the plurality of door glasses from deviating from the door frame due to a change of outside temperature.

The door may further include an insulation member having a different material from the outer frame and the inner frame to prevent heat transfer from the inner frame to the outer frame, and arranged between the inner frame and the outer frame.

The outer frame and the inner frame may include metals, and the insulation member may include a nonmetal.

Advantageous Effects of Disclosure

The disclosure may reduce product prices and simplify a manufacturing procedure by enhancing a door frame to support door glasses.

In the disclosure, an outer frame and an inner frame coupled to each other include metals so that the door glasses may be prevented from deviating from the door frame due to a change in outside temperature.

In the disclosure, an insulation member arranged between the outer frame and the inner frame includes a nonmetal so that heat transfer between the inner frame and the outer frame may be blocked, thereby preventing occurrences of dew condensation on the outer frame.

MODE OF DISCLOSURE

Figure 1:
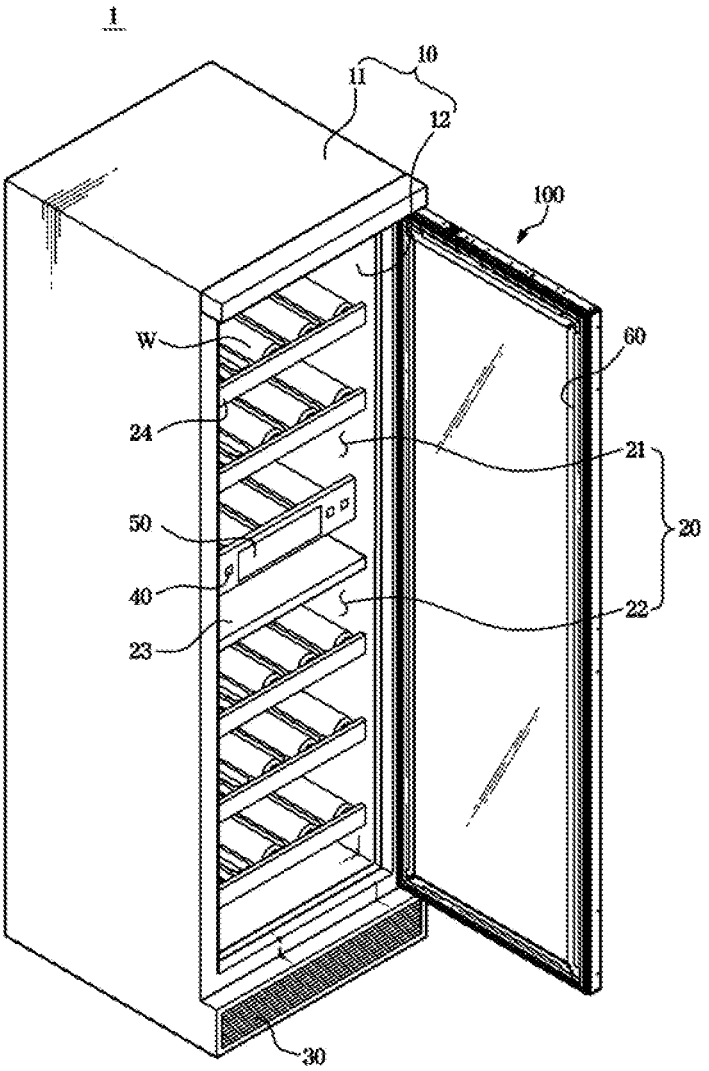
FIG. 1 is a perspective view of a refrigerator, according to an embodiment of the disclosure.

Embodiments and features as described and illustrated in the present disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another.

For example, the first component may be termed as the second component, and vice versa, within the scope of the present invention. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Reference will now be made in detail to embodiments, examples of which are illustrated in the accompanying drawings, wherein like reference numerals refer to the like elements throughout.

Food items stored in a refrigerator according to an embodiment of the disclosure may include food ingredients, soft drinks, alcoholic beverages, etc., and there are no limitations on types of the food items stored in the refrigerator. The embodiments will be focused on a refrigerator to keep bottled wines, for detailed explanation.

Figure 2:
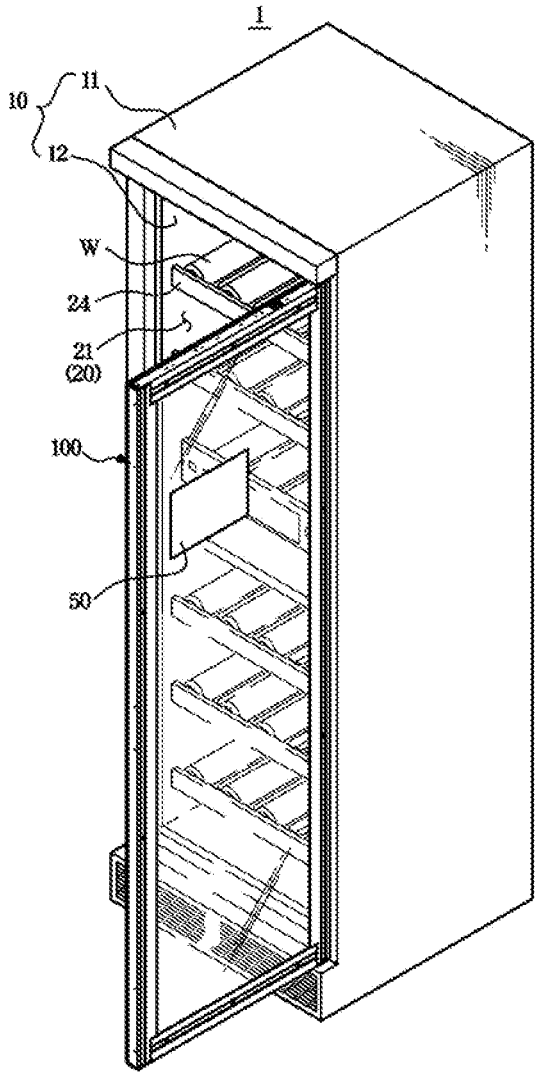
FIG. 2 illustrates an exterior of a refrigerator, according to an embodiment of the disclosure.
Figure 3:
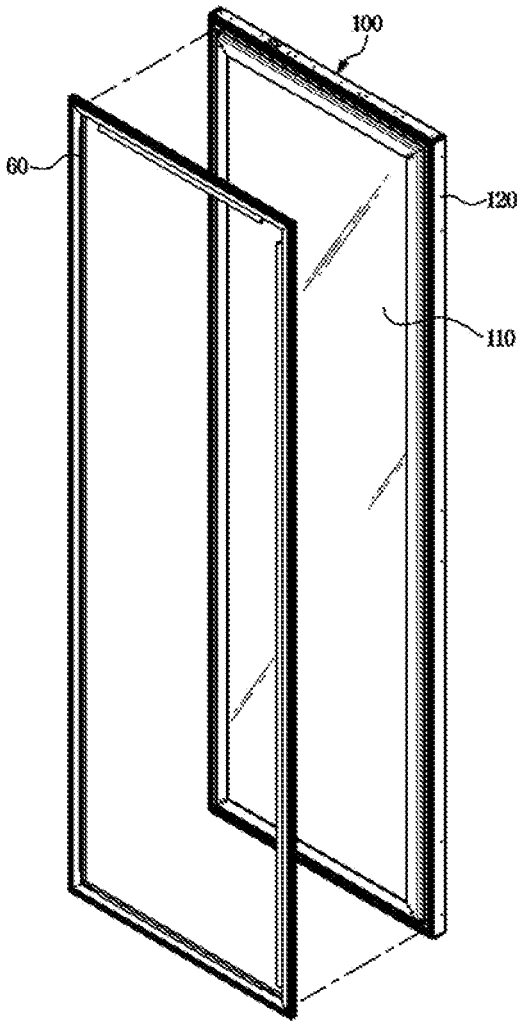
FIG. 3 shows a door and a gasket of a refrigerator decoupled from each other, according to an embodiment of the disclosure.

FIG. 1 is a perspective view of a refrigerator, according to an embodiment of the disclosure. FIG. 2 illustrates an exterior of a refrigerator, according to an embodiment of the disclosure. FIG. 3 shows a door and a gasket of a refrigerator decoupled from each other, according to an embodiment of the disclosure.

As shown in FIGS. 1 to 3, refrigerator 1 may include a main body 10, a storeroom 20 formed inside the main body 10 to store food items, and a cold air supplier (not shown) for supplying cold air into the storeroom 20.

The main body 10 may include a outer case 11 defining the exterior of the refrigerator 1, an inner case 12 defining the storeroom 20, and an insulation member (not shown) foamed between the outer case 11 and the inner case 12 to insulate the storeroom 20.

The storeroom 20 may store wines W. A plurality of racks 24 may be installed in the storeroom 20 to receive the plurality of wines W.

It is common to keep wine in a bottled state, so the term wine will hereinafter be referred to as a bottled wine W.

A machine room 30 may be formed underneath the main body 10, and the cold air supplier (not shown) for producing cold air to be supplied into the storeroom 20 may be installed in the machine room 30.

The storeroom 20 may be divided by a partition wall 23 into an upper storeroom 21 and a lower storeroom 22. The upper storeroom 21 and the lower storeroom 22 may be separated by the partition wall 23, so the air inside each storeroom may be cooled and maintained at a different temperature by the cold air supplier (not shown).

Wines W may have different temperatures to remain in best conditions depending on the types of the wines W, so the upper storeroom 21 and the lower storeroom 22 may be kept at different temperatures suitable for the different types of wines W, allowing the user to separately store his/her wines W depending on the types.

For example, it may be good to keep red wines at about 14 □ to 18 □ to maintain the taste and flavor and white wines at about 8 □ to 13 □.

Hence, the upper storeroom 21 may keep the inside temperature at 14 □ to 18 □ to store red wines and the lower storeroom 22 may keep the inside temperature at 8 □ to 13 □ to store white whines, so that red wines and white wines may be stored in their best conditions.

Alternatively, of course, the upper storeroom 21 may keep the inside temperature at temperatures suitable for white wines to store white wines, an the lower storeroom 21 may keep the inside temperature at temperatures suitable for red wines to store red wines.

In other words, the inside temperatures of the upper storeroom 21 and the lower storeroom 22 may be set and changed by the user.

The refrigerator 1 may include an input device 40 provided to receive a control command from the user, and a display device 50 for displaying status information, a screen to guide input of control commands, etc.

The front of the main body 10 is opened to put in or take out the wine W, and a door 100 may be installed on the open front. The door 100 may be pivotally installed, and the user may open or close the storeroom 20 by pivoting the door 100.

The door 100 may almost have a rectangular shape. It is not, however, limited thereto.

In an embodiment of the disclosure, the door 100 of the refrigerator 1 is shown as having the single door 100, but the door 100 may be equipped on each of the upper side and the lower side to open or close the upper storeroom 21 and the lower storeroom 22 separately, or alternatively, may be implemented as double doors.

The door 100 is implemented to be transparent, so the user outside may check the wine W kept inside or may check the display device 50 arranged inside. However, the door 100 may of course be implemented to be opaque.

The display device 50 may provide information relating to the refrigerator 1 or information relating to the wine W kept in the refrigerator 1 for the user. For example, the display device 50 may display information relating to the refrigerator 1 such as a temperature in the storeroom 20, or basic information for user convenience such as weather, date, time, etc.

The display device 50 may be implemented with a liquid crystal display (LCD) panel, a light emitting diode (LED) panel, organic light emitting diodes (OLEDs), or the like.

The input unit 40 may receive a control command from the user. For example, the input device 40 may receive control commands to turn on or off power of the refrigerator 1, set a temperature inside the storeroom 20, search for the wine W stored, or the like.

The input device 40 may be implemented in a button type as shown in FIG. 1, or implemented as a touch panel as shown in FIG. 2 to form a touch screen together with the display device 50. In this case, the user may enter a control command by touching the screen displayed by the display device 50.

The display device 50 and the input device 40 may be installed inside the main body 10 as shown in FIG. 1, or may be installed outside of the main body 10 as shown in FIG. 2.

Specifically, the display device 50 and the input device 40 may be installed at the rack 24 as shown in FIG. 1, or may be installed on the door 100 as shown in FIG. 2.

Alternatively, a portion of the input device 40 may be installed at the rack 24 while the others may be installed on the door 100.

The refrigerator 1 may include a gasket 60 arranged between the main body 10 and the door 100 to seal the interior of the storeroom 20. The gasket 60 may be coupled onto edges of the door 100.

The gasket 60 may be installed along the edges of the door 100 having almost a rectangular shape.

The gasket 60 may include four parts to support the respective sides of the door 100, which may be detachably coupled to each other, or may include a single part to form one body.

Figure 4:
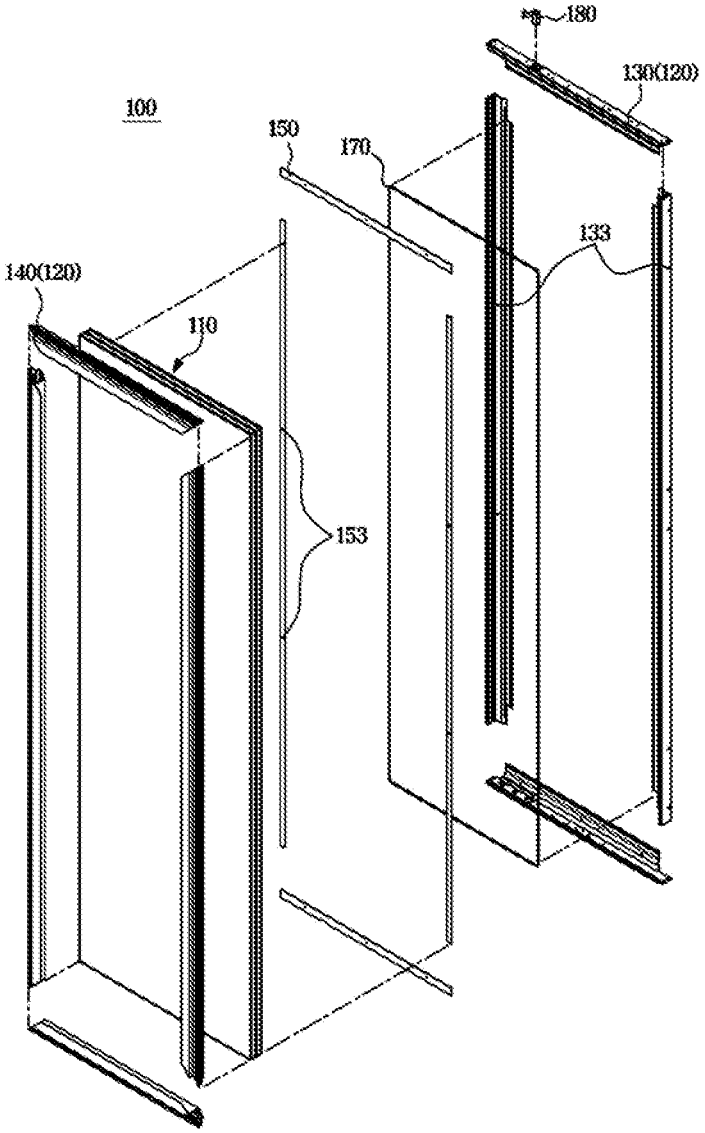
FIG. 4 shows a door glass and a door frame of a refrigerator decoupled from each other, according to an embodiment of the disclosure.
Figure 5:
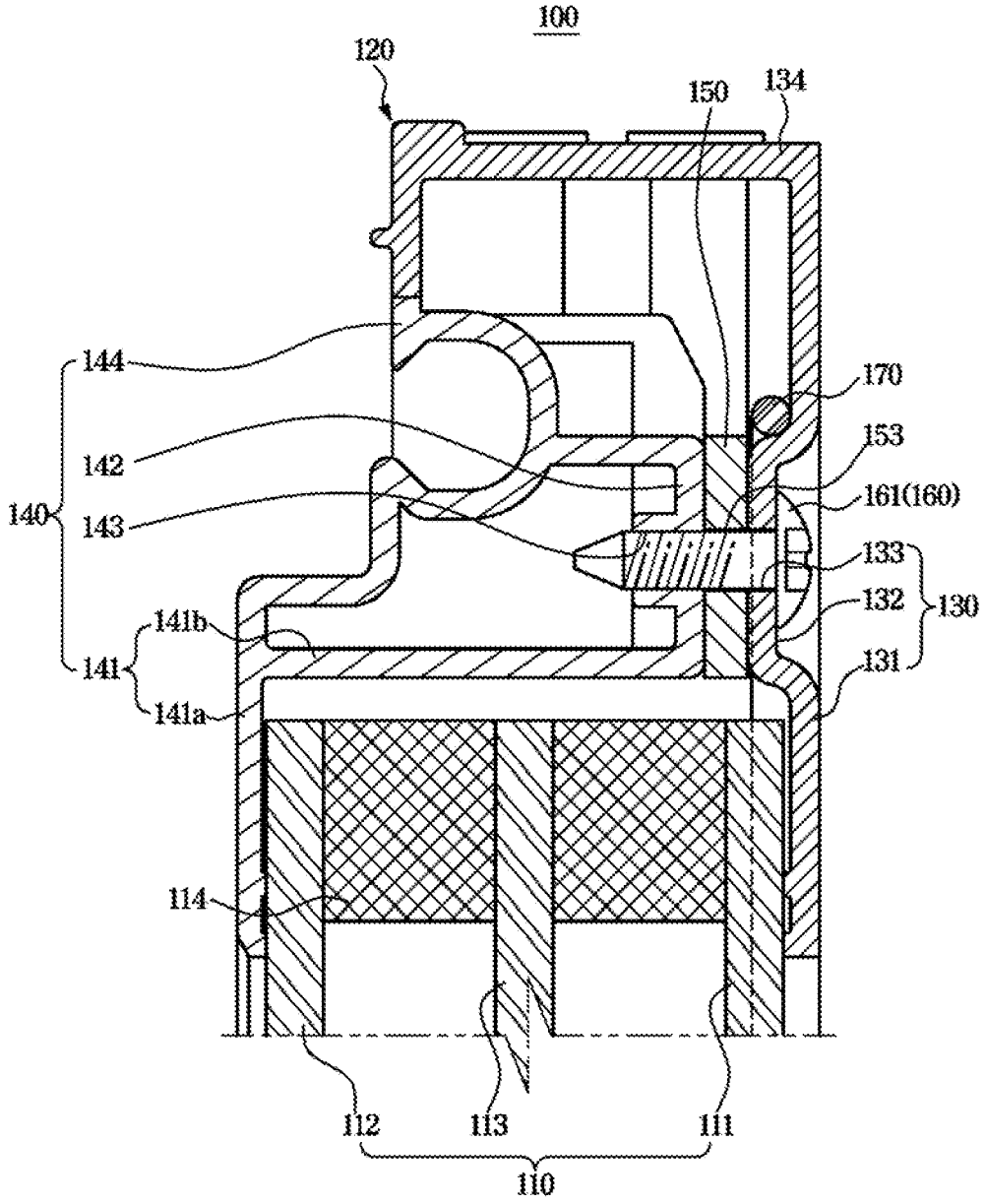
FIG. 5 is a side cross-sectional view illustrating a door glass and a door frame of a refrigerator coupled to each other, according to an embodiment of the disclosure.
Figure 6:
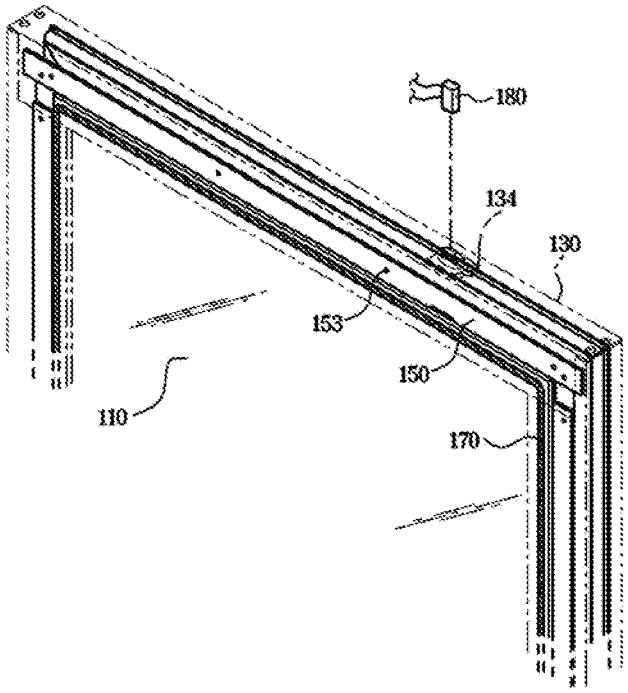
FIG. 6 shows a heater and a sensor arranged at a door frame of a refrigerator, according to an embodiment of the disclosure.

FIG. 4 shows a door glass and a door frame of a refrigerator decoupled from each other, according to an embodiment of the disclosure. FIG. 5 is a side cross-sectional view illustrating a door glass and a door frame of a refrigerator coupled to each other, according to an embodiment of the disclosure. FIG. 6 shows a heater and a sensor arranged at a door frame of a refrigerator, according to an embodiment of the disclosure.

As shown in FIGS. 4 to 6, the door 100 may include a door glass 110 and a door frame 120 to support the door glass 110. The door glass 110 may almost have a rectangular shape.

The door frame 120 may have almost a rectangular shape to support respective edges of the door glass 110 having the rectangular shape.

Although it is shown in FIG. 4 that the door frame 120 includes four door frames 120 to support the respective sides of the door glass 110 and the four door frames 120 are detachably coupled to each other, it is not limited thereto, and the four door frames may be integrally formed into one body The door glass 110 may include a plurality of door glasses 110 separately arranged to insulate the storeroom 20.

The door 100 of the refrigerator 1 (see FIG. 1) for storing the wine W (see FIG. 1) may include the transparent door glass 110 through which the user outside sees the wine W inside. Hence, transfer of heat into or from the storeroom 20 (see FIG. 1) through the door 100 may increase as compared with a door of a common grocery refrigerator, which insulates using urethane.

To make up for this, the door 100 may include a plurality of door glasses 110 and contain a gas with a lower heat conductivity than air between the plurality of door glasses 110, to improve insulation performance.

The door glasses 100 may include an outer glass 111 arranged on an outer side and an inner glass 112 arranged on an inner side among the plurality of door glasses 110.

The inner glass 112 may be arranged to open or close the storeroom 20, and the outer glass 111 may define the exterior of the door 100.

The door 100 may include a spacing member 114 provided to keep a distance between the outer glass 111 and the inner glass 112.

The door glass 100 may include a middle glass 113 arranged between the outer glass 111 and the inner glass 112.

The spacing member 114 may be provided in the plural, which may be arranged to keep distances between the outer glass 111 and the middle glass 113 and between the middle glass 113 and the inner glass 112.

Although it is shown in an embodiment of the disclosure that the door glasses 110 include three door glasses 110 including the outer glass 111, the inner glass 112, and the middle glass 113, it is not limited thereto, and there may be a different number of door glasses 110 as long as they are able to insulate the storeroom 20.

Similarly, although it is shown in an embodiment of the disclosure that the spacing members 114 include two spacing members 114 arranged between the outer glass 111 and the middle glass 113 and between the middle glass 113 and the inner glass 113, it is not limited thereto, and there may be a different number of spacing members 114 as long as they are able to keep distances between the plurality of door glasses 110.

Transfer of heat into or from the storeroom 20 through the door 100 by means of heat conduction may increase at edges of the door glass 110 coupled to the door frame 120 as compared with a center portion of the door glass 110.

This is because transfer of heat into or from the center portion of the door glass 110 is relatively blocked by a low conductive gas provided between the plurality of door glasses 110 than at edges of the door glass 110.

Hence, when dew condensation occurs on the door 100 because of high humidity outside the refrigerator 1, the dew condensation may start from the door frame 120 that supports edges of the door glass 110 rather than the center portion of the door glass 110.

The door frame 120 may require a function of suppressing occurrences of dew condensation on the door glass 110 by blocking external heat transfer inside the door 100 while securely supporting the plurality of door glasses 110*j*.

The door frame 120 may include an outer frame 130 to support the outer side of the door glass 110 and an inner frame 140 to support the inner side of the door glass 110. The outer frame 130 and the inner frame 140 may be coupled to each other.

The outer frame 130 and the inner frame 140 may include a same type of material.

When the outer frame 130 and the inner frame 140 coupled to each other include different types of materials, a difference in coefficient of linear expansion between the outer frame 130 and the inner frame 140 may increase.

The coefficient of linear expansion may refer to a length change per unit length of a material when the temperature changes by 1 □. That is, it may refer to a change in length of a solid material according to the temperature.

A large coefficient of linear expansion may mean that the size of a material significantly changes due to a change of temperature, so the coefficient of linear expansion of a material may be an important factor in selecting a material to be used for home appliances in particular.

When the difference in coefficient of linear expansion between the outer frame 130 and the inner frame 140 is big, and a change of the temperature outside the door 100 is large, coupling of the outer frame 130 and the inner frame 140 may be distorted.

It may cause air to flow into or out of the storeroom 20 through the distorted space between the outer frame 130 and the inner frame 140, and when a degree of the distortion between the outer frame 130 and the inner frame 140 is large, the coupling between the door glass 110 and the door frame 120 may be separated.

The outer frame 130 and the inner frame 140 may include a same type of material to prevent the door glass 110 from deviating from the door frame 120 due to a change of outside temperature.

A difference in the coefficient of linear expansion between the inner frame 140 and the outer frame 130 may be 10 um/mk or less. It is not, however, limited thereto.

The inner frame 140 and the outer frame 130 may have the same coefficient of linear expansion. The inner frame 140 and the outer frame 130 may include a same type of material.

The outer frame 130 and the inner frame 140 may include the same type of material so that the difference in the coefficient of linear expansion of the outer frame 130 and the inner frame 140 may be reduced, and distortion between the outer frame 130 and the inner frame 140 due to a change of temperature outside the door 100 may be prevented.

The outer frame 130 and the inner frame 140 may include metals. The outer frame 130 and the inner frame 140 may be coupled by a coupling member 160. The coupling member 160 may include a screw 161. The outer frame 130 and the inner frame 140 may be coupled by the screw 161.

In general, the outer frame may usually include a metal to prevent spreading of a fire when the fire breaks out in the wine refrigerator, and the inner frame may include a non-metal such as low heat-conductive plastics to prevent a chill in the storeroom from being transferred to the outer frame.

The inner frame including the nonmetal, however, may have its limitations to securely supporting the door glass.

In an embodiment of the disclosure, the outer frame 130 and the inner frame 140 may both include metals, thereby securely supporting the door glass 110 as compared with the case of including a non-metal.

In addition, the outer frame 130 and the inner frame 140 both include metals to be coupled by the screw 161.

An inner frame including a nonmetal may likely be damaged when coupled with the outer frame by the screw, but in the disclosure, the inner frame 140 includes a metal, so the outer frame 130 and the inner frame 140 may be coupled by the screw 161, and the door frame 120 may more securely support the door glass 110.

However, as the inner frame 140 in contact with the storeroom 20 includes a metal instead of a nonmetal such as plastics, heat conductivity of the inner frame 140 increases, making a chill in the storeroom 20 easily transferred to the outer frame 130.

To prevent this, the door 100 according to the disclosure may include the insulation member 150 arranged between the outer frame 130 and the inner frame 140. The insulation member 150 may include a different type of material from the inner frame 140. The insulation member 150 may include a different type of material from the outer frame 130.

The insulation member 150 may include a nonmetal. The insulation member 150 may include a resin. The insulation member 150 may include plastics.

The door 100 according to the disclosure includes the insulation member 150 having a nonmetal, to insulate space between the outer frame 130 and the inner frame 140 including metals.

Accordingly, the insulation member 150 may block heat transfer between the outer frame 130 and the inner frame 140, and may thus prevent a chill in the storeroom 20 from being transferred to the outer frame 130 via the inner frame 140.

The insulation member 150 may be arranged along side edges of the plurality of door glasses 100. The insulation member 150 may include a plurality of insulation members 150 separately arranged along the sides of the door glasses 110.

The plurality of insulation members 150 may have four parts arranged on respective sides of the door glass 110 shaped almost like a rectangular. It is not, however, limited thereto.

There may be a different number of insulation members 150 as long as they may prevent a chill in the storeroom 20 from being transferred to the outer frame 130 via the inner frame 140. For example, the plurality of insulation members 150 may be integrally formed into one body.

The outer frame 130 may include a first cover part 131 covering the outer surface of the outer glass 111, and a first insulation part 132 extending from the first cover part 131 and contacting the insulation member 150.

The first cover part 131 may be arranged in front of the outer glass 111, and the first insulation part 132 may extend upwards from the first cover part 131.

The inner frame 140 may include a second cover part 141 covering the inner surface of the inner glass 112, and a second insulation part 142 extending from the second cover part 141 and contacting the insulation member 150.

The second cover part 141 may include a second rear cover part 141*a* arranged to cover the rear surface of the inner glass 112, and a second top cover part 141*b* bending from the second rear cover part 141*a* to cover the top surface of the inner glass 112.

The second top cover part 141*b* may cover the top of the middle glass 113. The second top cover part 141*b* may cover the top of the spacing member 114.

The second insulation part 142 may bend upwards from the second top cover part 141*b*.

The outer frame 130 may include a first coupling part 133 provided at the first insulation part 132 for the outer frame 130 to be coupled with the inner frame 140 and the insulation member 150.

The inner frame 140 may include a second coupling part 143 provided at the second insulation part 142 for the inner frame 140 to be coupled with the first coupling part 133 and the insulation member 150.

The insulation member 150 may include a coupling hole 153 formed for the insulation member 150 to be coupled with the first coupling part 133 and the second coupling part 143.

The first coupling part 133, the second coupling part 143, and the coupling hole 153 may be coupled by the coupling member 160. The first coupling part 133, the second coupling part 143, and the coupling hole 153 may be bored through by the coupling member 160.

Although it is shown that the first coupling part 133, the second coupling part 143, and the coupling hole 153 forms a hole, it is not limited thereto. The first coupling part 133, the second coupling part 143, and the coupling hole 153 may be provided in various forms and numbers as long as they enable the outer frame 130, the inner frame 140, and the insulation member 150 to be coupled by the coupling member 160.

The door 100 may include a heater 170 arranged at the outer frame 130 to prevent occurrences of dew condensation on the door frame 120. The door 100 may include a sensor 180 for measuring humidity outside the door 100 so that the heater 170 operates depending on the humidity outside the door 100.

In general, to reinforce the coupling between the outer frame and the inner frame coupled by the coupling member, adhesive hot-melt, for example, may be used.

The hot-melt may fill up the space between the outer frame and the inner frame in a fluid state, and may then be hardened to more intensify the coupling between the outer frame and the inner frame.

However, when the hot-melt is applied in a passive process, the process may require a long time and accuracy may go down, and when the hot-melt is applied in an automated process, equipment investment prices may increase.

In an embodiment of the disclosure, the door 100 does not use the hot-melt, thereby facilitating assembling of the door glass 110 and the door frame 120 and reducing an assembling process time.

In an embodiment of the disclosure, the door 100 may include the heater 170 to prevent occurrences of dew condensation on the outer frame 130 due to a minor spring of chills between the outer frame 130 and the inner frame 140 that might occur when the hot-melt is not used.

The heater 170 may be placed in various positions as long as the heater 170 may prevent occurrences of dew condensation on the outer frame 130.

The heater 170 may have almost a rectangular shape along the outer frame 130 shaped almost like a rectangular.

Although it is shown that the heater 170 is an integral body along the outer frame 130, it is not limited thereto. The heater 170 may be provided in various forms and numbers as long as the heater 170 may prevent occurrences of dew condensation on the outer frame 130.

For example, the heater 170 may include four heaters 170 to be coupled to the outer frame 130 to be separated from one another.

In an embodiment of the disclosure, the door 100 may include the sensor 180 for measuring humidity outside the door 100 to control an operation rate of the heater 170 according to the outside humidity.

Hence, when the humidity outside the door 100 is low, the heater 170 may be controlled to have a reduced operation rate or not to be operated, thereby minimizing electricity consumption.

The outer frame 130 may include a sensor installation part 134 provided to receive the sensor 180. The sensor installation part 134 may extend from the first insulation part 132. The sensor installation part 134 may extend upwards from the first insulation part 132.

It is not, however, limited thereto, and the sensor 180 may be arranged in various positions as long as the sensor 180 may measure humidity outside the door 100 to control the operation rate of the heater 170.

For example, the sensor 180 may be mounted in the main body 10 (see FIG. 1) instead of the door 100.

The inner frame 140 may include a gasket installation part 144 provided to be coupled with the gasket 60 (see FIG. 3). The gasket installation part 144 may be arranged between the second cover part 141 and the second insulation part 142.

Figure 7:
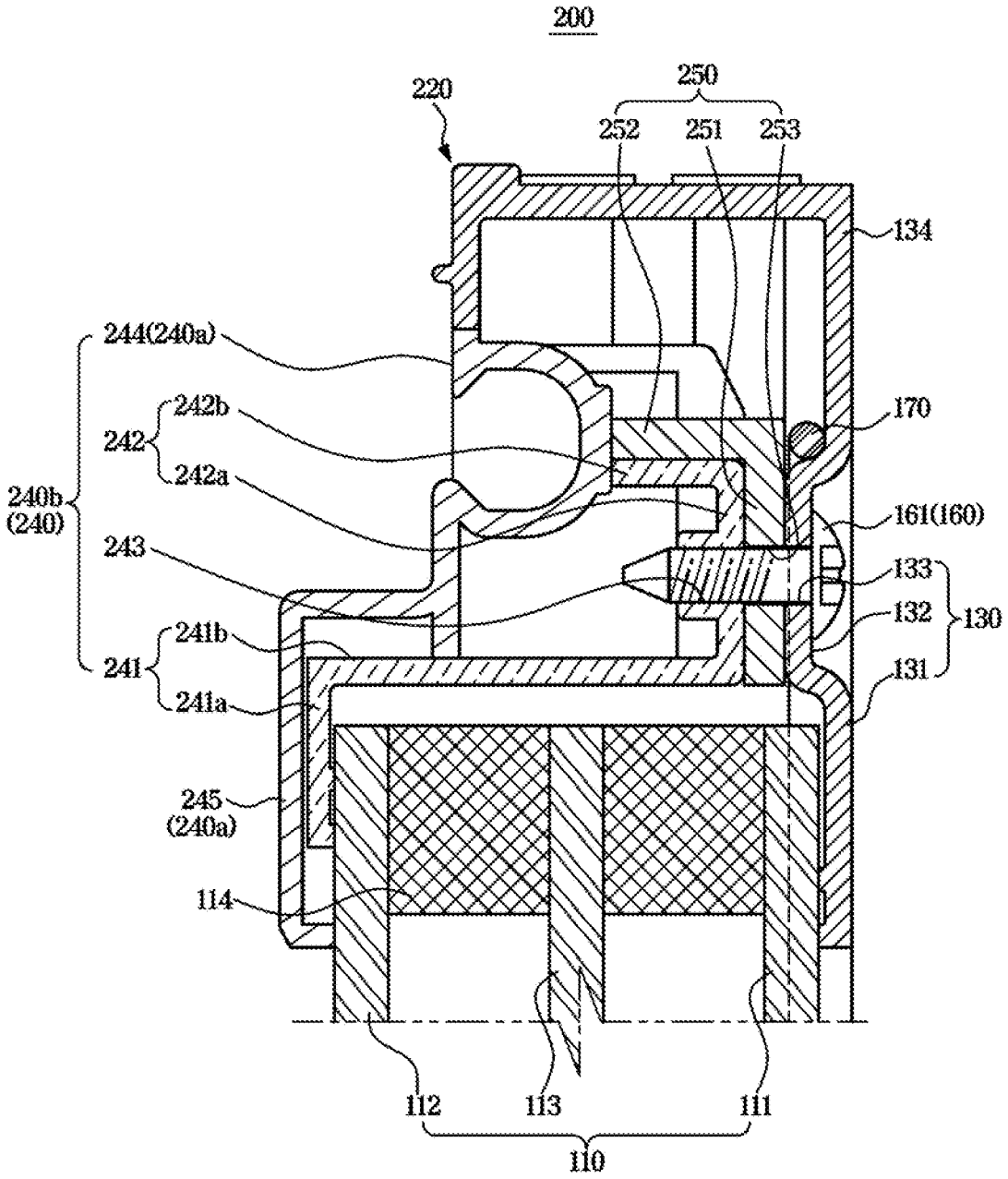
FIG. 7 is a side cross-sectional view illustrating a door glass and a door frame of a refrigerator coupled to each other, according to another embodiment of the disclosure.

FIG. 7 is a side cross-sectional view illustrating a door glass and a door frame of a refrigerator coupled to each other, according to another embodiment of the disclosure.

As shown in FIG. 7, an inner frame 240 may include a first inner frame 240*a* coupled with the gasket 60 provided to seal the storeroom 20, and a second inner frame 240*b* arranged between the outer frame 130 and the first inner frame 240*a*.

In this embodiment of the disclosure, a door frame 220 has almost the same structure as the door frame 120 in the previous embodiment of the disclosure except for some differences in the inner frame 240 and an insulation member 250, and the same reference numerals are used for the same components.

The door frame 220 according to this embodiment of the disclosure will now be described by focusing on the difference from the door frame 120 in the previous embodiment of the disclosure.

A door 200 may include the door glass 110 and a door frame 220 to support the door glass 110.

The door frame 220 may include the outer frame 130 to support the outer side of the door glass 110 and the inner frame 240 to support the inner side of the door glass 110. The outer frame 130 and the inner frame 240 may be coupled to each other.

The inner frame 240 may include the second inner frame 240*b* to support the inner side of the door glass 110 and the first inner frame 240*a* arranged behind the second inner frame 240*b*.

The second inner frame 240*b* may be coupled with the outer frame 130. The second inner frame 240*b* may be coupled with the first inner frame 240*a*.

The outer frame 130 and the second inner frame 240*b* may include a same type of material.

The outer frame 130 and the second inner frame 240*b* may include the same type of material to prevent the door glass 110 from deviating from the door frame 220 due to a change of outside temperature.

A difference in the coefficient of linear expansion between the second inner frame 240*b* and the outer frame 130 may be 10 um/mk or less. It is not, however, limited thereto.

The second inner frame 240*b* and the outer frame 130 may have the same coefficient of linear expansion. The second inner frame 240*b* and the outer frame 130 may include a same material.

The outer frame 130 and the second inner frame 240*b* may include the same type of material so that the difference in the coefficient of linear expansion of the outer frame 130 and the second inner frame 240*b* may be reduced, and distortion between the outer frame 130 and the second inner frame 240*b* due to a change of temperature outside the door 200 may be prevented.

The outer frame 130 and the second inner frame 240*b* may include metals. The outer frame 130 and the second inner frame 240*b* may be coupled by the coupling member 160. The coupling member 160 may include the screw 161. The outer frame 130 and the second inner frame 240*b* may be coupled by the screw 161.

In this embodiment of the disclosure, the outer frame 130 and the second inner frame 240*b* may both include metals, thereby securely supporting the door glass 110 as compared with the case of including nonmetals.

In addition, the outer frame 130 and the second inner frame 240*b* both include metals, so that they may be coupled by the screw 161.

However, as the second inner frame 240*b* adjacent to the storeroom 20 includes the metal instead of a nonmetal such as plastics, heat conductivity of the second inner frame 240*b* increases, making a chill in the storeroom 20 easily transferred to the outer frame 130.

To prevent this, the door 200 according to this embodiment of the disclosure may include the first inner frame 240*a* including a different material from the second inner frame 240*b*, and the first inner frame 240*a* may be arranged between the storeroom 20 and the second inner frame 240*b* to insulate the storeroom 20.

The first inner frame 240*a* may include a different type of material from the outer frame 130. The first inner frame 240*a* may include a nonmetal. The first inner frame 240*a* may include a resin. The first inner frame 240*a* may include plastics.

As the first inner frame 240*a* having the nonmetal is included, chills in the storeroom 20 may not be transferred to the outside of the storeroom 20 through the door frame 220.

The door 200 may include an insulation member 250 arranged between the outer frame 130 and the second inner frame 240*b*. The insulation member 250 may include a different type of material from the second inner frame 240*b*. The insulation member 250 may include a different type of material from the outer frame 130.

The insulation member 250 may include a nonmetal. The insulation member 250 may include a resin. The insulation member 250 may include plastics.

The door 200 according to this embodiment of the disclosure includes the insulation member 250 having the nonmetal to insulate space between the outer frame 130 and the second inner frame 240*b* including metals.

Accordingly, the insulation member 250 may block heat transfer between the outer frame 130 and the second inner frame 240*b*, and may thus prevent a chill in the storeroom 20 from being transferred to the outer frame 130 via the second inner frame 240*b*.

The insulation member 250 may include a first insulation member 251 arranged adjacent to the outer glass 111, and a second insulation member 252 bending from the first insulation member 251 towards the inner glass 112. That is, the insulation member 250 may have the shape of almost ' 1'. It is not, however, limited thereto.

The first insulation member 251 may be arranged above the outer glass 111, and the second insulation member 252 may extend from the first insulation member 251 to be arranged above the inner glass 112 towards the inner glass 112.

The outer frame 130 may include the first cover part 131 covering the outer surface of the outer glass 111, and the first insulation part 132 extending from the first cover part 131 and contacting the insulation member 250.

The second inner frame 240*a* may include a second cover part 241 covering the inner surface of the inner glass 112, and a second insulation part 242 extending from the second cover part 241 and contacting the insulation member 250.

The second cover part 241 may include a second rear cover part 241*a* arranged to cover the rear surface of the inner glass 112, and a second top cover part 241*b* bending from the second rear cover part 241*a* to cover the top surface of the inner glass 112.

The second top cover part 241*b* may cover the top of the middle glass 113. The second top cover part 241*b* may cover the top of the spacing member 114.

The second insulation part 242 may bend upwards from the second top cover part 241*b*.

The second insulation part 242 may include a second lower insulation part 242*a* extending from the second top cover part 241*b* to be arranged adjacent to the first insulation member 251, and a second upper insulation part 242*b* arranged adjacent to the second insulation member 252.

The second lower insulation part 242*a* may contact the first insulation member 251. The second upper insulation part 242*b* may bend from the second lower insulation part 242*a* towards the inner glass 112, and contact the second insulation member 252.

The outer frame 130 may include the first coupling part 133 provided at the first insulation part 132 for the outer frame 130 to be coupled with the second inner frame 240*b* and the insulation member 250.

The second inner frame 240*b* may include a second coupling part 243 provided at the second insulation part 242 for the inner frame 240 to be coupled with the first coupling part 133 and the insulation member 250.

The second coupling part 243 may be provided at the second lower insulation part 242*a*.

The first insulation member 251 may include a coupling hole 253 formed for the first insulation member 251 to be coupled with the first coupling part 133 and the second coupling part 243.

The first coupling part 133, the second coupling part 243, and the coupling hole 253 may be coupled by the coupling member 160. The first coupling part 133, the second coupling part 243, and the coupling hole 253 may be bored through by the coupling member 160.

Although it is shown that the first coupling part 133, the second coupling part 243, and the coupling hole 253 forms a hole, it is not limited thereto. The first coupling part 133, the second coupling part 243, and the coupling hole 253 may be provided in various forms and numbers as long as they enable the outer frame 130, the inner frame 240, and the insulation member 250 to be coupled by the coupling member 160.

The door 200 may include a heater 170 arranged at the outer frame 130 to prevent occurrences of dew condensation on the door frame 220. The door 200 may include a sensor 180 for measuring humidity outside the door 200 so that the heater 170 operates depending on the humidity outside the door 200.

In this embodiment of the disclosure, the door 200 may include the heater 170 to prevent occurrences of dew condensation on the outer frame 130 due to a minor spring of chills between the outer frame 130 and the second inner frame 240*b* that might occur when the hot-melt is not used.

In the disclosure, the door 200 may include the sensor 180 for measuring humidity outside the door 200 to control an operation rate of the heater 170 according to the outside humidity.

The outer frame 130 may include a sensor installation part 134 provided to receive the sensor 180. The sensor installation part 134 may extend from the first insulation part 132.

The first inner frame 240*a* may include a gasket installation part 244 provided to be coupled with the gasket 60 (see FIG. 3). The gasket installation part 244 may be arranged between the second cover part 241 and the second insulation part 242.

The gasket installation part 244 may be arranged between the first rear cover part 241*a* and the first upper insulation part 242*b*. It is not, however, limited thereto.

The first inner frame 240*a* may include a third cover part 245 extending from the gasket installation part 244 to cover the rear of the second cover part 241.

The third cover part 245 may extend downwards from the gasket installation part 244. The second rear cover part 241*a* may be arranged between the third cover part 245 and the inner glass 112.

The third cover part 245 including a nonmetal may be arranged between the storeroom 20 and the second cover part 241 to insulate the space between the storeroom 20 and the second inner frame 240*b*.

Although the technical ideas of the disclosure have been described with reference to the aforementioned particular embodiments, the scope of right of the disclosure is not limited to the embodiments.

It will be understood by those of ordinary skill in the art that various changes in form and details may be made therein without departing from the spirit and scope of the disclosure as defined by the appended claims and their equivalents.

The invention claimed is:

1. A refrigerator comprising:

a main body including a storeroom;

a plurality of door glasses separately arranged to insulate the storeroom;

an outer frame supporting an outer glass arranged on an outer side among the plurality of door glasses;

an inner frame supporting an inner glass arranged on an inner side among the plurality of door glasses and including a same type of material as the outer frame;

an insulation member arranged between the outer frame and the inner frame and including a different type of material from the outer frame and the inner frame; and a coupling member passing through the outer frame, the insulation member, and the inner frame, extending in a front-to-rear direction, to couple the outer frame and the inner frame together, wherein the outer frame and the inner frame are separate members.

2. The refrigerator of claim 1, wherein the insulation member includes at least one of a resin and a plastic.

3. The refrigerator of claim 1, wherein a difference in coefficient of linear expansion between the inner frame and the outer frame is 10 um/mk or less.

4. The refrigerator of claim 1, wherein the coupling member is a screw.

5. The refrigerator of claim 1, wherein the outer frame and the inner frame comprise metals, and the insulation member comprises a nonmetal.

6. The refrigerator of claim 1, wherein the insulation member is arranged along side edges of the plurality of door glasses.

7. The refrigerator of claim 1, wherein the insulation member comprises a first insulation member arranged adjacent to the outer glass and a second insulation member bending from the first insulation member towards the inner glass.

8. The refrigerator of claim 1, wherein the outer frame comprises a first cover part covering an outer surface of the outer glass, a first insulation part extending from the first cover part and contacting the insulation member, and a first coupling part provided at the first insulation part so that the outer frame is coupled with the inner frame and the insulation member.

9. The refrigerator of claim 8, wherein the inner frame comprises a second cover part covering an inner surface of the inner glass, a second insulation part extending from the second cover part and contacting the insulation member, and a second coupling part provided at the second insulation part so that the inner frame is coupled with the first coupling part and the insulation member.

10. The refrigerator of claim 1, wherein the insulation member comprises a coupling hole through which the coupling member passes to couple the outer frame and the inner frame together.

11. The refrigerator of claim 1, wherein the inner frame comprises a first inner frame coupled with a gasket provided to seal the storeroom and a second inner frame arranged between the outer frame and the first inner frame.

12. The refrigerator of claim 11, wherein the first inner frame comprises a nonmetal, and the second inner frame comprises a metal.

13. The refrigerator of claim 1, wherein the insulation member comprises a plurality of insulation members arranged along sides of the door glass and separated from one another.

14. The refrigerator of claim 1, further comprising:

a heater arranged at the outer frame to prevent occurrences of dew condensation on the outer frame or the inner frame.

15. The refrigerator of claim 14, further comprising:

a sensor measuring outside humidity of the refrigerator so that the heater operates according to the outside humidity.

* * * * *